US007306370B2

(12) United States Patent
Howell et al.

(10) Patent No.: US 7,306,370 B2
(45) Date of Patent: Dec. 11, 2007

(54) SHROUDED FLEXIBLE PACKAGES

(75) Inventors: Hal Marvin Howell, Chicago, IL (US); Kelly Elizabeth Arnold, Chicago, IL (US); Amy L. Gosselin, Westchester, IL (US); Panagiotis Kinigakis, Buffalo Grove, IL (US); Kenneth Charles Pokusa, Indian Head Park, IL (US); Kenneth V. Radakovits, Orland Park, IL (US); Jim Kyung Sung, Lake Villa, IL (US); Trisha Ann Wood, Wheeling, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 427 days.

(21) Appl. No.: 10/730,615

(22) Filed: Dec. 8, 2003

(65) Prior Publication Data

US 2005/0025395 A1 Feb. 3, 2005

Related U.S. Application Data

(63) Continuation-in-part of application No. 10/631,630, filed on Jul. 31, 2003.

(51) Int. Cl.
*B65D 33/16* (2006.01)
*B65D 33/00* (2006.01)

(52) U.S. Cl. ..... 383/64; 383/61.2; 383/204

(58) Field of Classification Search ..... 383/61.2, 383/203–204, 63–64
See application file for complete search history.

(56) References Cited

U.S. PATENT DOCUMENTS 2,994,469 A 8/1961 Troup et al.
3,234,614 A 2/1966 Plummer
3,534,520 A 10/1970 Moran
3,579,747 A 5/1971 Hawley
3,660,875 A 5/1972 Gutman
3,790,992 A 2/1974 Herz
3,806,998 A 4/1974 Laguerre
3,819,106 A 6/1974 Schuster
4,186,786 A 2/1980 Kirkpatrick
4,262,395 A 4/1981 Kosky
4,355,494 A 10/1982 Tilman
4,516,268 A 5/1985 Kamp
4,534,158 A 8/1985 McClosky
4,586,319 A 5/1986 Ausnit
4,601,694 A 7/1986 Ausnit
4,617,785 A 10/1986 Chikatami et al.
4,646,511 A 3/1987 Boeckmann et al.

(Continued)

FOREIGN PATENT DOCUMENTS

EP 0 443 867 A1 8/1991

(Continued)

*Primary Examiner*—Jes F. Pascua
(74) *Attorney, Agent, or Firm*—Fitch, Even, Tabin & Flannery

(57) ABSTRACT

A shrouded flexible package is provided with an improved continuous laser score line. The score line has end portions adjacent the side seals of the package, which are located above fastener tracks which are enclosed by a shroud portion of the package. The score line contains downwardly and inwardly converging segments joined to a medial score line segment extending along side and generally below the fastener tracks. The score line is preferably formed with a laser energy source.

5 Claims, 4 Drawing Sheets

U.S. PATENT DOCUMENTS

| | | | |
|---|---|---|---|
| 4,709,533 | A | 12/1987 | Ausnit |
| 4,727,709 | A | 3/1988 | Zieke et al. |
| 4,745,731 | A | 5/1988 | Talbott et al. |
| 4,812,074 | A | 3/1989 | Ausnit et al. |
| 4,848,064 | A | 7/1989 | Lems et al. |
| 4,878,987 | A | 11/1989 | Ven Erden |
| 4,894,975 | A | 1/1990 | Ausnit |
| 4,903,841 | A | 2/1990 | Oshima et al. |
| 4,909,017 | A | 3/1990 | Mcmahon et al. |
| 4,945,714 | A | 8/1990 | Bodolav et al. |
| 5,010,627 | A | 4/1991 | Herrington et al. |
| 5,014,489 | A | 5/1991 | Terminella et al. |
| 5,014,498 | A | 5/1991 | McMahon |
| 5,014,499 | A | 5/1991 | Boeckmann |
| 5,020,194 | A | 6/1991 | Herrington et al. |
| 5,036,643 | A | 8/1991 | Bodolay |
| 5,067,208 | A | 11/1991 | Herrington, Jr. et al. |
| 5,080,747 | A | 1/1992 | Veix |
| 5,088,971 | A | 2/1992 | Herrington |
| 5,127,208 | A | 7/1992 | Custer et al. |
| 5,131,121 | A | 7/1992 | Herrington et al. |
| 5,140,796 | A | 8/1992 | Pope |
| 5,141,795 | A | 8/1992 | Kai et al. |
| 5,167,107 | A | 12/1992 | Terminella et al. |
| 5,179,816 | A | 1/1993 | Wojnicki |
| 5,186,543 | A | 2/1993 | Cochrarn |
| 5,189,764 | A | 3/1993 | Herrington et al. |
| 5,238,306 | A | 8/1993 | Heintz et al. |
| 5,247,781 | A | 9/1993 | Runge |
| 5,283,932 | A | 2/1994 | Richardson et al. |
| 5,301,395 | A | 4/1994 | Richardson et al. |
| 5,322,579 | A | 6/1994 | Van Erden |
| 5,400,565 | A | 3/1995 | Terminella et al. |
| RE34,905 | E | 4/1995 | Ausnit |
| 5,405,478 | A | 4/1995 | Richardson et al. |
| 5,417,035 | A | 5/1995 | English |
| 5,442,837 | A | 8/1995 | Morgan |
| 5,482,375 | A | 1/1996 | Richardson et al. |
| 5,492,411 | A | 2/1996 | May |
| 5,505,037 | A | 4/1996 | Terminella et al. |
| 5,519,982 | A | 5/1996 | Herber et al. |
| 5,525,363 | A | 6/1996 | Herber et al. |
| 5,561,966 | A | 10/1996 | English |
| 5,564,259 | A | 10/1996 | Stolmeier |
| 5,664,299 | A | 9/1997 | Porchia et al. |
| 5,664,406 | A | 9/1997 | Smith |
| 5,669,715 | A | 9/1997 | Dobreski et al. |
| 5,681,115 | A | 10/1997 | Diederich et al. |
| 5,682,730 | A | 11/1997 | Dobreski |
| 5,687,549 | A | 11/1997 | Jostler et al. |
| 5,713,669 | A | 2/1998 | Thomas et al. |
| 5,722,128 | A | 3/1998 | Toney et al. |
| 5,725,312 | A | 3/1998 | May |
| 5,733,045 | A | 3/1998 | Jostler et al. |
| 5,743,070 | A | 4/1998 | Lerner et al. |
| 5,746,043 | A | 5/1998 | Terminella et al. |
| 5,768,852 | A | 6/1998 | Terminella et al. |
| 5,769,772 | A | 6/1998 | Wiley |
| 5,775,812 | A | 7/1998 | St. Phillips et al. |
| 5,776,045 | A | 7/1998 | Bodolay et al. |
| 5,826,401 | A | 10/1998 | Bois |
| 5,836,056 | A | 11/1998 | Porchia et al. |
| 5,845,465 | A | 12/1998 | Bennett |
| 5,845,466 | A | 12/1998 | Laudenberg |
| 5,871,281 | A | 2/1999 | Stolmeier et al. |
| 5,878,549 | A | 3/1999 | Littmann et al. |
| 5,884,452 | A | 3/1999 | Bois |
| 5,904,425 | A | 5/1999 | May |
| 5,906,438 | A | 5/1999 | Laudenberg |
| 5,924,173 | A | 7/1999 | Dobreski et al. |
| 5,930,983 | A | 8/1999 | Terminella et al. |
| 5,937,615 | A | 8/1999 | Forman |
| 5,938,337 | A | 8/1999 | Provan et al. |
| 5,947,603 | A | 9/1999 | Tilman |
| 5,950,285 | A | 9/1999 | Porchia et al. |
| 5,956,815 | A | 9/1999 | O'Connor et al. |
| 5,956,924 | A | 9/1999 | Thieman |
| 5,983,594 | A | 11/1999 | Forman |
| 5,985,384 | A | 11/1999 | Shibata |
| 5,996,187 | A | 12/1999 | Tanaka et al. |
| 6,000,197 | A | 12/1999 | Ausnit |
| 6,029,428 | A | 2/2000 | Terminella et al. |
| 6,036,364 | A | 3/2000 | Heuvel |
| 6,044,621 | A | 4/2000 | Malin et al. |
| 6,047,450 | A | 4/2000 | Machacek et al. |
| 6,047,521 | A | 4/2000 | Terminella et al. |
| 6,071,011 | A | 6/2000 | Thomas et al. |
| 6,088,887 | A | 7/2000 | Bois |
| 6,131,369 | A | 10/2000 | Asunit |
| 6,131,370 | A | 10/2000 | Ausnit |
| 6,138,436 | A | 10/2000 | Malin et al. |
| 6,138,439 | A | 10/2000 | McMahon et al. |
| 6,139,662 | A | 10/2000 | Forman |
| 6,148,588 | A | 11/2000 | Thomas et al. |
| 6,149,302 | A | 11/2000 | Taheri |
| 6,161,271 | A | 12/2000 | Schreiter |
| 6,178,722 | B1 | 1/2001 | McMahon |
| 6,183,134 | B1 | 2/2001 | Malin |
| 6,185,907 | B1 | 2/2001 | Malin et al. |
| 6,186,663 | B1 | 2/2001 | Ausnit |
| 6,199,351 | B1 | 3/2001 | Mount |
| 6,209,287 | B1 | 4/2001 | Thieman |
| 6,212,857 | B1 | 4/2001 | Van Erden |
| 6,216,423 | B1 | 4/2001 | Theiman |
| 6,219,993 | B1 | 4/2001 | Linkiewicz |
| 6,220,754 | B1 | 4/2001 | Stiglic et al. |
| 6,224,262 | B1 | 5/2001 | Hogan et al. |
| 6,244,021 | B1 | 6/2001 | Ausnit et al. |
| 6,244,746 | B1 | 6/2001 | Tokita et al. |
| 6,270,256 | B1 | 8/2001 | Todman |
| 6,273,607 | B1 | 8/2001 | Buchman |
| 6,286,189 | B1 | 9/2001 | Provan et al. |
| 6,287,000 | B1 | 9/2001 | Buchman |
| 6,287,001 | B1 | 9/2001 | Buchman |
| 6,290,390 | B1 | 9/2001 | Buchman |
| 6,290,391 | B1 | 9/2001 | Buchman |
| 6,290,393 | B1 | 9/2001 | Tomic |
| 6,292,986 | B1 | 9/2001 | Provan et al. |
| 6,293,896 | B1 | 9/2001 | Buchman |
| 6,327,754 | B1 | 12/2001 | Belmont et al. |
| 6,327,837 | B1 | 12/2001 | Van Erden |
| 6,347,885 | B1 | 2/2002 | Buchman |
| 6,360,513 | B1 | 3/2002 | Strand et al. |
| 6,363,692 | B2 | 4/2002 | Thieman |
| 6,364,530 | B1 | 4/2002 | Buchman |
| 6,378,177 | B1 | 4/2002 | Athans et al. |
| 6,389,780 | B1 | 5/2002 | Coomber et al. |
| 6,412,254 | B1 | 7/2002 | Tilman et al. |
| 6,427,421 | B1 | 8/2002 | Belmont et al. |
| 6,438,926 | B1 | 8/2002 | Thieman |
| 6,449,924 | B2 | 9/2002 | McMahon et al. |
| 6,470,551 | B1 | 10/2002 | Provan et al. |
| 6,474,045 | B2 | 11/2002 | McMahon et al. |
| 6,477,821 | B1 | 11/2002 | Bois |
| 6,481,183 | B1 | 11/2002 | Schmidt |
| 6,499,272 | B2 | 12/2002 | Thieman |
| 6,910,806 | B2 * | 6/2005 | Strand et al. ..... 383/61.2 |
| 6,939,041 | B2 * | 9/2005 | Kinigakis et al. ..... 383/61.2 |
| 6,974,256 | B2 * | 12/2005 | Kinigakis et al. ..... 383/64 |
| 2001/0001164 | A1 | 5/2001 | Van Erden |
| 2001/0017950 | A1 | 8/2001 | Strand et al. |
| 2001/0039235 | A1 | 11/2001 | Buchman |
| 2001/0039783 | A1 | 11/2001 | McMahon et al. |
| 2001/0042357 | A1 | 11/2001 | McMahon et al. |

2001/0045083 A1 11/2001 McMahon et al.
2001/0053253 A1 12/2001 Buchman
2002/0017078 A1 2/2002 Thieman
2002/0064320 A1 5/2002 May
2002/0064321 A1 5/2002 May
2002/0064322 A1 5/2002 May
2002/0068668 A1 6/2002 Chow et al.
2002/0076122 A1 6/2002 Buchman
2002/0118896 A1 8/2002 Forman
2002/0134046 A1 9/2002 Bois
2002/0134050 A1 9/2002 Thieman
2002/0150313 A1 10/2002 Bois
2002/0152719 A1 10/2002 Kinigakis et al.
2002/0152720 A1 10/2002 Kinigakis et al.
2002/0173414 A1 11/2002 Leighton
2002/0178556 A1 12/2002 McMahon et al.
2002/0184858 A1 12/2002 Ausnit et al.
2002/0194818 A1 12/2002 Thieman
2002/0196987 A1* 12/2002 Tilman et al. ..... 383/5
2003/0219176 A1* 11/2003 Kocher et al. ..... 383/64

FOREIGN PATENT DOCUMENTS

EP 1 164 087 A2 12/2001
EP 1251075 A 10/2002
EP 1367000 A 12/2003
JP 01-226556 9/1989
JP 04-173510 6/1992
JP 10203539 A 8/1998
JP 11157553 A 6/1999
WO WO 98/24704 6/1998
WO WO 98/45180 10/1998
WO WO 01/96195 A1 12/2001

* cited by examiner

SHROUDED FLEXIBLE PACKAGES

CROSS REFERENCE TO RELATED APPLICATION

This is a continuation-in-part of prior application Ser. No. 10/631,630, filed Jul. 31, 2003, which is incorporated herein by reference in its entirety.

BACKGROUND OF THE INVENTION

1. Field of the Invention

The present invention pertains to flexible packages having fastener closures employing sliders and, in particular, to such packages having a shroud enclosure for the slider.

2. Description of the Related Art

Consumers purchasing bulk quantities of food products have come to rely upon the recloseable packaging. One of the most popular means of providing reclosability is to employ zippers of various types, particularly zippers which are compatible with flexible packages of plastic film construction. Manufacturers of food products and other commodities are concerned with filling the contents of a flexible package as quickly and as economically as possible, utilizing mass production forming, filling and sealing techniques. Shrouded packages add a level of complexity to the packaging efforts, in that the package construction must be carefully coordinated with manufacture and assembly of the fastener components. Other difficulties arise when the consumer opens the shrouded package for the first time. As an initial step, the consumer must gain access to the fastener components, particularly the slider. This requires the shroud, which usually spans the entire width of the fastener system, to be entirely removed. It is generally preferred that the shroud be removed in a simple tearing operation, without requiring tools or comaterial strips. It is important that the tearing be made reliable and that it leave clean edges on the flexible package, once removed.

SUMMARY OF THE INVENTION

One embodiment of the invention relates to a recloseable, flexible package in which opposed front and rear panels are joined to first and second interlockable fastener tracks. A slider is movable along the fastener tracks for closing and opening. A shroud covers the slider in at least a portion of the fastener tracks and a continuous weakening portion in the shroud, generally coextensive with the fastener tracks, severs the upper portion of the package, i.e., the shroud, for removal. The weakening portion is preferably formed as a laser score line. The score line is located adjacent a side seal of the package at a point above the fastener tracks and then crosses over the fastener tracks, continuing along a line spaced from and generally below the fastener tracks. The side seal may contain a slit or cutout communicating with the laser score line to provide assistance for the initial tearing effort. The score line preferably is non-linear overall, but may have either linear or curved sections.

DETAILED DESCRIPTION OF THE PREFERRED EMBODIMENTS

Figure 7:
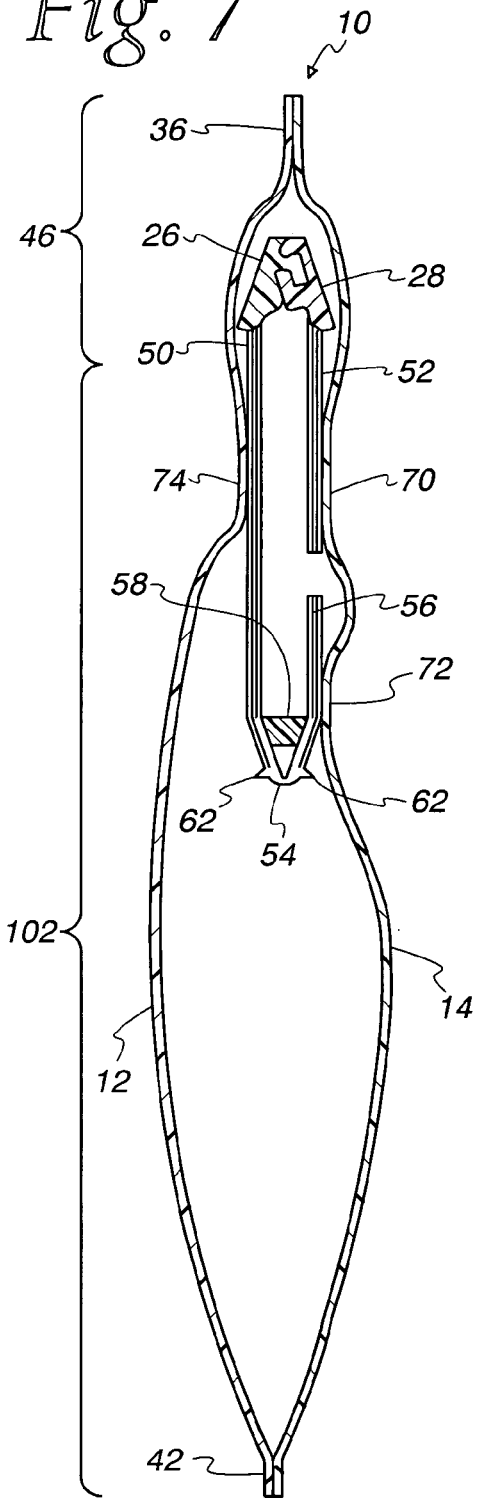
FIG. 7 is a cross-sectional view taken along the line 7-7 of FIG. 1.
Figure 8:
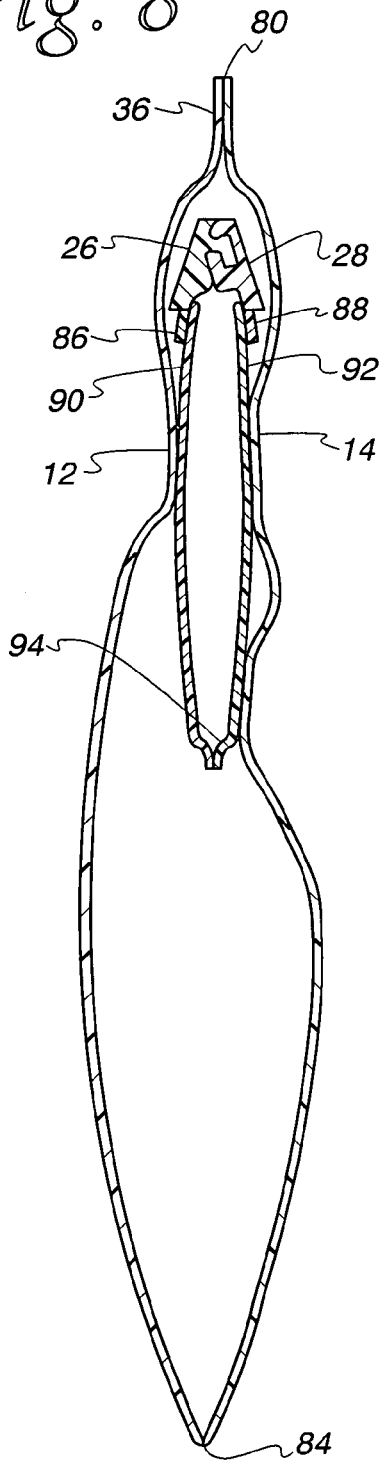
FIG. 8 is a cross-sectional view similar to that of FIG. 7 but showing an alternative construction of the fastener tracks.

Referring now to the drawings and initially to FIGS. 1-4, a flexible package is generally indicated at 10. The terms "package" and "bag" are used interchangeably and are not intended to refer to any relative size of the finished item. Flexible package 10 preferably takes the form of a plastic bag having front and back panels 12, 14 joined together at the left end by a side or marginal seal 20 and at the right end by a side or marginal seal 22. The side seals 20, 22 are preferably of conventional conduction heat-seal construction, having a generally constant width throughout. If desired, the side seals can be made to have a width which varies along their length (see FIG. 6). The bottom of package 10 can take on virtually any conventional construction known today. For example, the front and rear panels can be sealed with a fin or marginal seal as shown at the bottom of FIG. 7 or the bottom of the package can be formed with a dead fold as can be seen at the bottom of FIG. 8. If desired, an adjusted bottom construction can also be employed.

The upper end of flexible package 10 features a recloseable opening including a slide fastener arrangement with fastener tracks 26, 28 and a slider 30, all preferably of polyolefin material. The slider 30 is slidable along the fastener tracks, causing the fastener tracks to interlock or mate for closure of the flexible package and to unmate or separate to open the flexible package for access to contents in the package interior. As illustrated in FIGS. 7 and 8, the fastener tracks can be made in a variety of different forms, as will be described herein. Generally, it is preferred that the specific tracks be installed in a manner which provides a rupturable or peelable seal which must be breached upon initial entry to the package interior.

The panels 12, 14 of plastic sheet material can be of a homogeneous or single material type such as polyolefin materials including polyethylene and polypropylene. Preferably the plastic sheets comprise a laminate assembly of several different material types, as is known in the art to provide a barrier to moisture as well as certain gases, such as oxygen or inert fillers of the types used with food products. Other types of laminate films, such as those known in the art to preserve food freshness, may also be employed. Where the contents of the flexible package are not perishable, or where other considerations may dictate, the panels 12, 14 can be constructed without regard to gas or vapor barrier properties.

Figure 1:
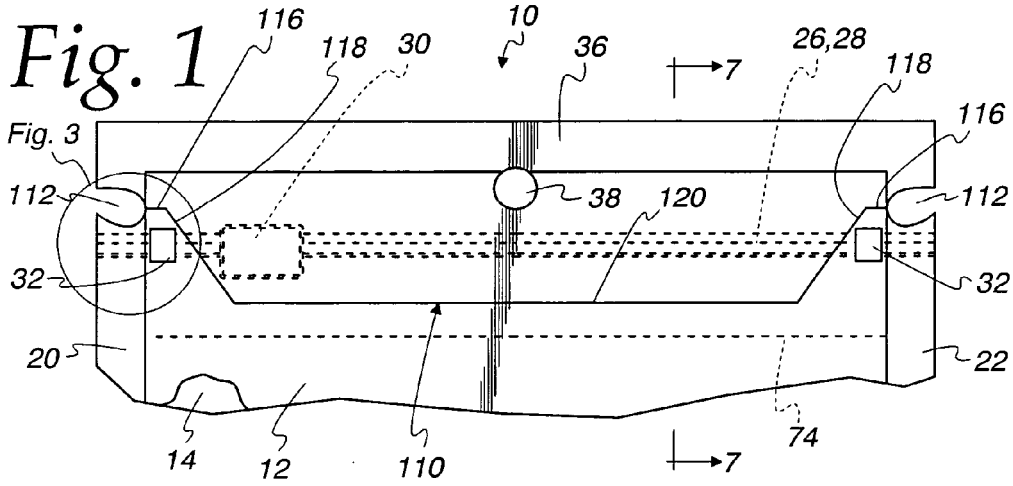
FIG. 1 is a fragmentary front elevational view of a flexible package in accordance with the present invention.

Referring to FIG. 1, when slider 30 is moved to the right, the fastener tracks 26, 28 are unlocked, opening the flexible package 10 and allowing the user access to either the package interior or to a rupturable peelable seal providing a final barrier to the package interior and the products contained therein. End stops 32 are formed in the fastener tracks to hold slider 30 captive. Preferably, end stop portions 32 are spaced from the side or marginal seals 20, 22 to prevent distortion of the stops arising from heating as the side seals are formed. Other arrangements are, however, contemplated by the present invention, as will be explained below. The upper end of package 10 may be formed with a dead fold or with a preferred marginal or fin seal 36 shown in the figures. A peg hole 38 is formed at the upper end of package 10 and may intrude into the upper seal 36, if desired.

Figure 2:
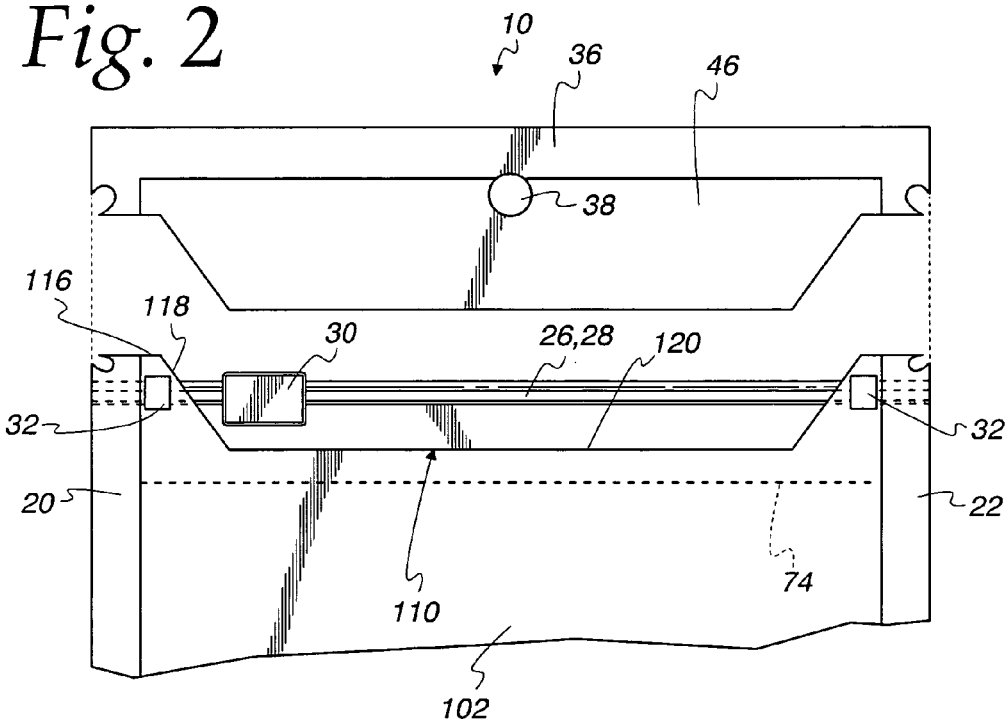
FIG. 2 is a fragmentary exploded perspective view showing removal of the shroud.
Figure 3:
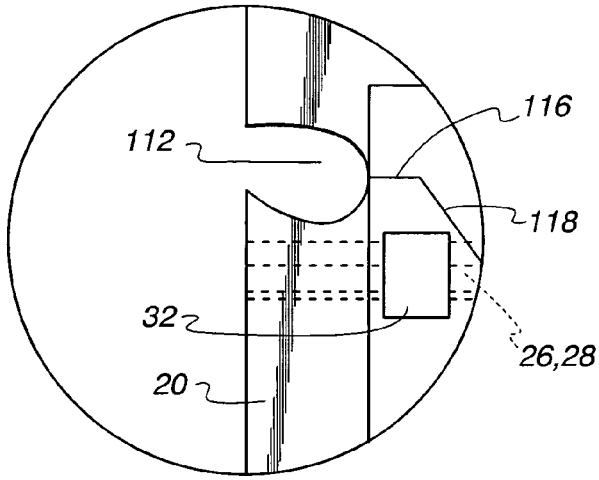
FIG. 3 is a fragmentary view of FIG. 1, taking on an enlarged scale.
Figure 4:
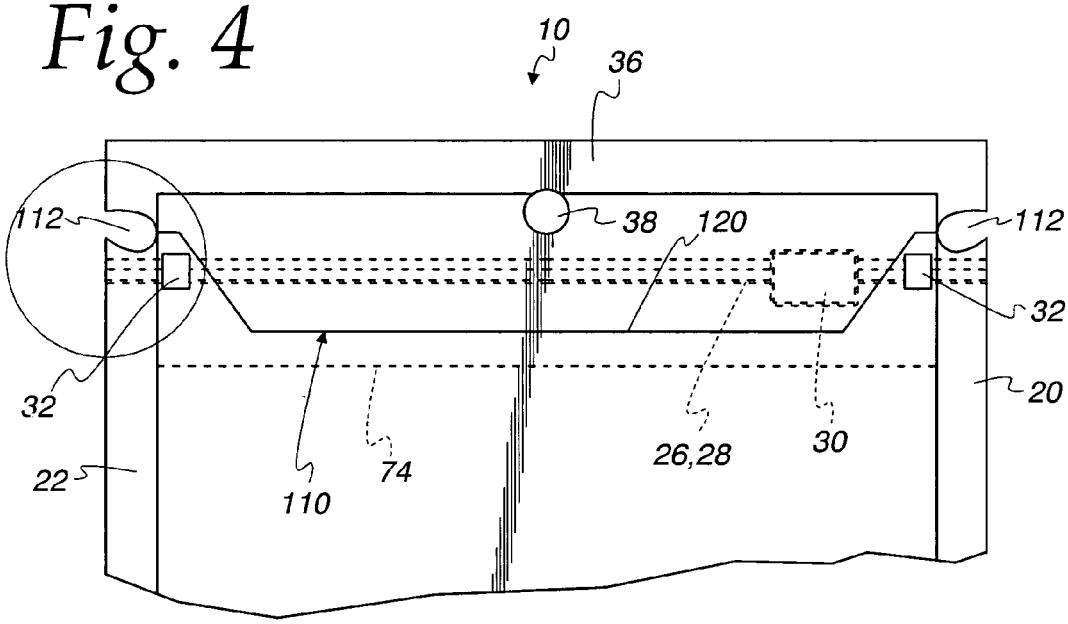
FIG. 4 is a rear elevational view of the package.

Turning now to FIG. 7, the bottom ends of panels 12, 14 of package 10 are sealed with a fin seal or marginal seal 42. In a preferred embodiment, as illustrated, panels 12, 14 extend the full height of package 10 between top and bottom seals 36, 42. The upper portions of panels 12, 14 indicated by the reference numeral 46 together comprise a shroud portion covering the fastener tracks 26, 28. FIG. 2 shows the shroud portion 46 separated from the remaining portion 102 of bag 10, i.e., the package sidewalls, so as to expose the slider 30 and the fastener tracks 26, 28.

Referring again to FIG. 7, flanges 50, 52 depend from fastener tracks 26, 28. Preferably, the flanges have a double layer thickness with both layers of the flange including a sealant material. The longer flange 50 continued upwardly from bottom portion 54 to form an opposed wall portion 56. Bottom portion 54 is preferably formed as a rupturable reverse fold. As shown in FIG. 7, the opposed wall 56 is arranged in line with the shorter flange 52, with flange 52 and flange portion 56 having adjacent spaced apart free ends. The reverse fold of bottom portion 54 is preferably maintained by a tack seal 58. The bottom portion 54 as illustrated, has a reduced thickness with material being displaced into a pair of ridges 62. It is generally preferred that the bottom portion 54 be sufficiently weakened so as to be readily opened by a consumer in accessing the package interior after removing the shroud and operating the slider members so as to unmate the fastener tracks. As desired, the reverse fold weakened area can be replaced by a conventional peel seal design.

As shown in FIG. 7, fusion seals 70, 72 and 74 are employed to join the fastener track assembly to panels 12, 14. Fusion seal 74 joins a pre-seal portion of the longer flange 50 to panel 12. Fusion seal 70 joins the lower portion of shorter flange 52 to panel 14 while fusion seal 72 joins wall portion 56 to a portion of panel 14 spaced from fusion seal 70.

Turning now to FIG. 8, an alternative arrangement of a flexible package 80 is shown. Package 80 is substantially identical to package 10 except for the construction of the zipper track assembly and its joinder to panels 12, 14 and the use of a dead fold 84 which joins together the bottom ends of panels 12, 14. The fastener tracks 26, 28 have tail portions 86 joined to flanges 90, 92. A peelable seal 94 joins the bottom ends of flanges 90, 92, but must be breached by the consumer as a final step prior to gaining access to the interior of package 80.

If desired, other fastener track arrangements different from those described above may be employed. As mentioned, the peelable seal features or other rupturable seal internal to the package can be omitted, if desired, as when the package is employed for non-perishable items.

It is important that a consumer or other end user of the flexible package be able to quickly gain access to the package interior without requiring special tools or by following detailed directions. Opening of the package 10 should be intuitive and the removal of the shroud should leave clean edges. The present invention contemplates removal of the shroud by tearing the panel material from which the upper shroud portion (e.g., see reference numeral 46 in FIG. 7) and the remaining side wall portions (see reference numeral 2 in FIG. 7) are formed.

Turning now to FIGS. 1-4 and 7, a two-dimensional (i.e., non-linear) score line 110 extends from one side of package 10 to the other. As shown in FIG. 1, it is generally preferred that score line 110 extends up to side or marginal seals 20, 22. In a preferred embodiment, curved cutout portions 112 remove material from the side seals 20, 22. As shown, cutout portions 112 are preferably continuously curved with the ends of score line 110 intercepting the innermost edge of the cutout, adjacent the inner edge the side or marginal seals. Score line 110 includes initially horizontal portions of relatively small length, extending but generally parallel to the fastener tracks. The initial portion is indicated by reference numeral 116, located at a point above the fastener tracks and above the stop 32 for slider 30. Score line 110 further includes a portion 118 inwardly and downwardly directed, crossing over the fastener tracks 26, 28 thus to meet with a medial portion 120 spaced below and oriented generally parallel to the fastener tracks. If desired, score line 110 could be formed of discreet segments but preferably is continuously formed without interruption, from end to end. Knives, dies or other tooling can be used to form the score line 110, as is package panel may not be aligned precisely with the score line formed in the opposing package panel. This latter feature is important when a user grasps both sides of the shroud together in a tearing operation, thus applying at a single point, tension to misaligned panel upper portions.

In one commercial embodiment, flexible package 10 comprises a plastic bag having a width of approximately 6.5 inches from side edge to side edge and a total overall height of approximately 10.75 inches. The fastener tracks 26, 28 have a height of approximately 4 mm, while the side seals have a width ranging between 2 and 5 mm. The cutout 112 has a generally oval shape, as illustrated, with a six millimeter vertical dimension. The initial segment of the score line 116 has a length of approximately 10 mm and the converging section of the score line 118 forms an angle of approximately 45° to the top and side marginal edges of the package.

Figure 6:
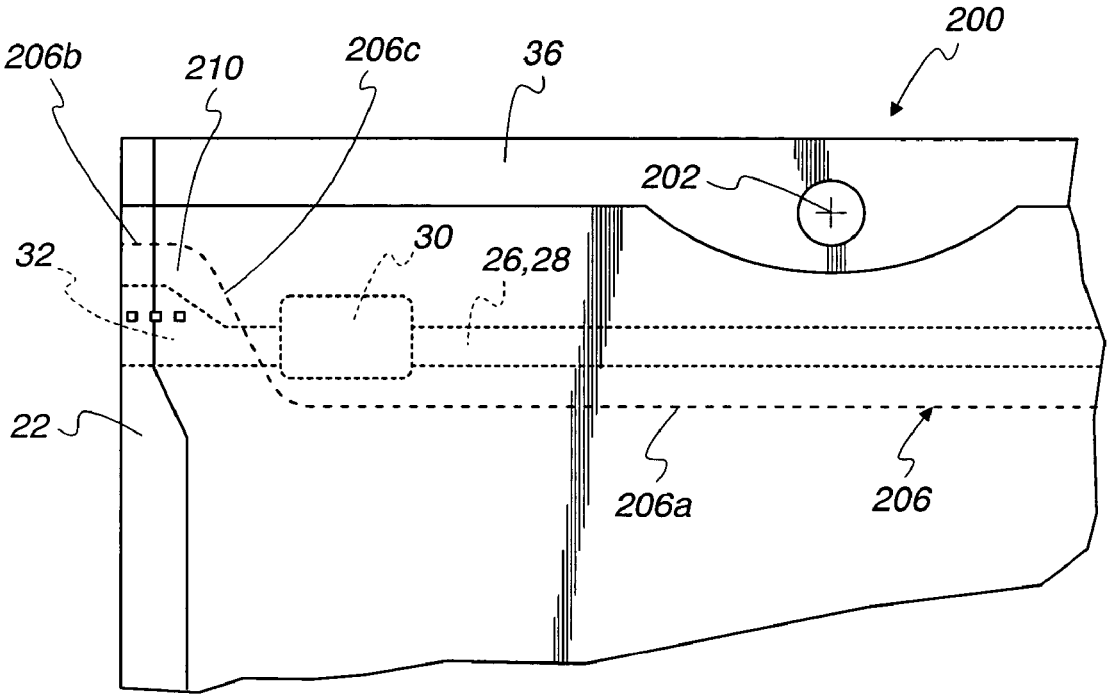
FIG. 6 is a fragmentary front elevational view of another embodiment of a flexible package according to principles of the present invention.

Referring now to FIG. 6, an alternative embodiment of a package according to principles of the present invention is generally indicated at 200. Package 200 has features identical to the package described above with reference to FIG. 1, except for peg hole 202 formed entirely within top margin 36, which includes a bulge in the area of the peg hole. As a second difference, the score line 206 is continuously curved and extends across the side seal 22. As can be seen in FIG. 6, side seal 22 has a non-constant width, being narrower in its upper portion and wider at its lower portion, with a width-wise transition located generally at the central portion 206*a* of score line 206. As mentioned, the score line 206 crosses side seal 22 and, in the preferred embodiment, is shown as a relatively short, generally horizontal segment 206*b*. The score line includes curved transitions on either side of a convergent sloping segment 206*c*.

As shown in FIG. 6, fastener tracks 26, 28 are deformed, being enlarged in the vicinity of side seal 22. The deformation comprises slider stop 32 and, as shown in FIG. 6, the slider stop displaces fastener track material in a generally upward direction with a sloping portion generally underneath the sloping portion 206*c* of score line 206 and a generally horizontal portion in the region of overlap with side seal 22. As with the preceding embodiments, it is generally preferred that panel material 210 be left covering the fastener tracks and extending above the end of the fastener tracks, adjacent side seal 22, after the shroud is removed. The covering portion 210 further assists in maintaining slider 30 captive on fastener tracks 26, 28 and can replace the known in the art, but preferably score line 110 is formed using a laser energy source, which has been found to provide superior tear direction and clean edges once the shroud is separated.

Referring to FIG. 2, it will be seen that portions of the package panels are left in place covering the end stops 32. With this desired positioning of the score line 110, the triangular portions of the package panels underneath the score line parts 116, 118 may be relied upon to hold slider 30 captive on fastener tracks 26, 28, thus allowing the elimination of end stops 32. It will be noted in this regard that the portions of the package panels interfering with the fastener tracks after shroud removal extend above the fastener tracks by a substantial distance, further ensuring that the slider will remain captive on the fastener tracks after access to the package interior is gained. If desired, the application tooling used to form side seals 20, 22 can be formed to displace fastener track material within the side seal area and vertical directions below and especially above the fastener tracks to back up the panel material remaining above and below the ends of the fastener tracks after shroud removal.

As can be seen, for example, in FIG. 2, the central portion 120 of laser score line 110 is spaced a substantial distance below the fastener tracks. The lower most portion of the laser score line is still located well above the peel seal features of the package, which are provided utilizing flanges of the fastener track assembly. Thus, due to this first aspect, package integrity is preserved. As a second feature preserving package integrity, a continuous unbroken score line is employed as the preferred form of weakness which allows separation of the shroud. Thus, the shroud enclosing the fastener tracks remains unbroken, awaiting customer removal of the shroud.

As mentioned before, the line of weakness provided for separating the shroud is preferably formed using a laser energy source to provide a two-dimensional, that is, non-linear score line. Use of a laser energy source, particularly when forming a non-linear score line, results in improved reliability of the tearing separation of the shroud portion. Once initiated at the oval-cutouts 112, tearing extends along a relatively short segment 116 before being directed generally at a 45° downward angle to the central portion 120. The use of a laser energy source to form the score line and the shape of the score line described above, has been found to result in surprisingly reliable uniform tearing during shroud removal even when the package panels are of relatively thin and stretchable material, and even though the score line formed in one stop 32, if desired, for this purpose provided that the side seal 22 include fusion of panels 12, 14 above the stops. As with the preceding embodiments, it is generally preferred that score line 206 be formed using a laser energy source.

Only one side of package 200 is shown in FIG. 6. It is generally preferred that portion of the score line at the right-hand side of the package (not visible in FIG. 6) comprises a mirror image of the opposing side, as illustrated. However, if desired, the end portions of the score lines (i.e., those portions adjacent the side seals of the package) need not be identical, i.e., need not comprise mirror images of one another. If desired, a notch or cutout can be formed, either in a portion of side seal 22, or the entirety thereof, adjacent score line segment 206*b*. As shown in FIG. 6, score line 206 is continuously curved, i.e., does not contain angled portions, as illustrated in FIG. 1, for example. If desired, the score line can contain angled portions. However, it is generally preferred that the score line be continuous from one side of the package to the other.

Figure 5:
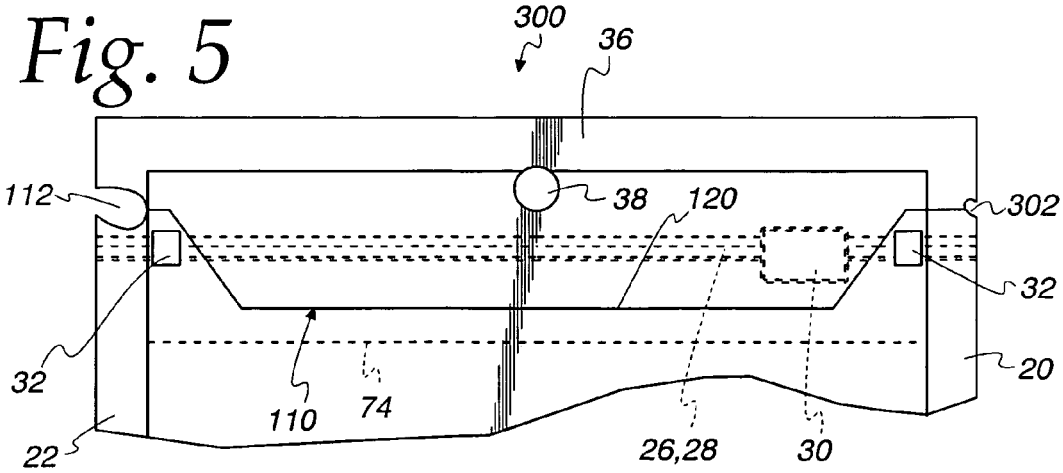
FIG. 5 is a fragmentary front elevational view of an alternative embodiment of a flexible package according to principles of the present invention.

Referring now to FIG. 5, a flexible package 300 is generally identical to the flexible package 10 described above, except that the cutout 302 formed in side seal 20 is different from the cutout 112 formed in side seal 22. In FIG. 5, slider 30 is shown in the fully opened position. Preferably, package 300 includes a peel seal located below the fastener tracks and thus, in light of this feature and the preserved integrity of the shroud portion, the fastener tracks can be shipped in an open position, if desired. Generally, however, it is preferred that the fastener tracks be fully mated and that slider 30 be located adjacent side seal 22, as shown for example in FIG. 1. Cutout 302, can be seen is continuously curved, but has a smaller size than cutout 112. Accordingly, score line 110 is extended across a portion of side seal 20 so as to communicate with cutout 302, ensuring continuous control of the tearing operation, should the consumer initiate tearing at side seal 20.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A reclosable package comprising:

first and second panels having opposed top and bottom ends, opposed lateral sides joined together by side seals, said first and said second panels comprising upper shroud portions and lower sidewall portions cooperating to form an interior cavity of said reclosable package;

first and second interlocking fastener tracks carried on said first and said second panels, respectively, so as to be spaced from their top ends, the fastener tracks extending from the side seal of one of the opposed lateral sides to the side seal of the other of the opposed lateral sides;

a slider movable along said fastener tracks for locking and unlocking said fastener tracks;

end stops formed in said fastener tracks adjacent said side seals and inwardly therefrom;

a continuous laser score line formed in each of said first and said second panels to separate the shroud portions from the sidewall portions of said first and said second panels, said score lines extending adjacent said lateral sides at a point above said fastener tracks, downwardly across said fastener tracks at an incline after clearing said end stops and alongside said fastener tracks, so that with rupture of said score lines said shroud portions are removed, exposing said slider and said fastener tracks.

2. The package of claim 1 further comprising cutouts in said side seals communication with said score lines.

3. The package of claim 1 wherein said score lines comprise straight line segments.

4. The package of claim 1 wherein, with said shroud portions removed, portions of said first and said second panels cover end parts of said slider and said fastener tracks adjacent said side seals.

5. The package of claim 1 wherein said score lines extending downwardly across said fastener tracks at an incline of approximately 45 degrees to the side seals.

* * * * *

UNITED STATES PATENT AND TRADEMARK OFFICE

CERTIFICATE OF CORRECTION

PATENT NO. : 7,306,370 B2
APPLICATION NO. : 10/730615
DATED : December 11, 2007
INVENTOR(S) : Howell et al.

It is certified that error appears in the above-identified patent and that said Letters Patent is hereby corrected as shown below:

In Column 6 line 56 claim 2, delete “communication” and insert -- communicating --.

Signed and Sealed this

Thirteenth Day of May, 2008

JON W. DUDAS
*Director of the United States Patent and Trademark Office*